United States Patent [19]

Kotzolt

[11] Patent Number: 4,628,660

[45] Date of Patent: Dec. 16, 1986

[54] CONSTRUCTION KIT FOR PRODUCING LIGHT-TUBE SYSTEMS FOR THREE-DIMENSIONAL FRAMEWORKS

[76] Inventor: Guenter Kotzolt, Lagesche Strasse 74, Lemgo 1, Fed. Rep. of Germany

[21] Appl. No.: 556,394

[22] Filed: Nov. 30, 1983

[30] Foreign Application Priority Data

Jan. 8, 1983 [DE] Fed. Rep. of Germany ... 8300417[U]

[51] Int. Cl.[4] ..... E04H 12/00

[52] U.S. Cl. ..... 52/648; 52/651; 403/344

[58] Field of Search ..... 403/344; 285/413, 415; 52/105, 109, 111, 117, 121, 632, 638, 641, 645, 646, 648, 651, 652

[56] References Cited

U.S. PATENT DOCUMENTS

| | | | |
|---|---|---|---|
| 945,106 | 1/1910 | Moodey | 403/344 |
| 1,509,022 | 9/1924 | Noble | 403/344 |
| 2,585,489 | 2/1952 | Myers | 403/344 |
| 3,294,053 | 12/1966 | Emery, Jr. | 403/170 |
| 3,537,150 | 11/1970 | Emberson | 403/344 |
| 4,373,235 | 2/1983 | Korgaonkar | 403/344 |
| 4,386,919 | 6/1983 | Kadono | 403/344 |

FOREIGN PATENT DOCUMENTS

| | | | |
|---|---|---|---|
| 0018005 | 2/1982 | European Pat. Off. . | |
| 2742458 | 3/1978 | Fed. Rep. of Germany | 403/344 |
| 2556813 | 12/1979 | Fed. Rep. of Germany . | |
| 2915778 | 10/1981 | Fed. Rep. of Germany . | |

*Primary Examiner*—John E. Murtagh
*Assistant Examiner*—Andrew Joseph Rudy
*Attorney, Agent, or Firm*—Schwartz, Jeffery, Schwaab; Mack, Blumenthal & Evans

[57] ABSTRACT

A construction kit for producing lighting-tube systems or three-dimensional frameworks, comprising tubes connected by connecting pieces, wherein the connecting pieces each have at least one tubular extension, and wherein the tubes which are divided along axis-parallel surface lines into two interlockable tube shells. The tubes have, at each of their ends, a horseshoe-shaped end flange. The end flange is connected to one of the tube shells, and can be pushed in a radial direction onto the tubular extension of the connecting piece. The end flange is also connected to an arcuate closing flange which can be locked with the end flange to form a closed ring surrounding the tubular extension.

11 Claims, 9 Drawing Figures

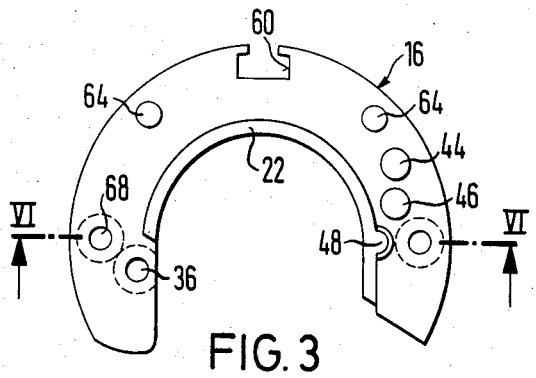
FIG. 3
FIG. 4
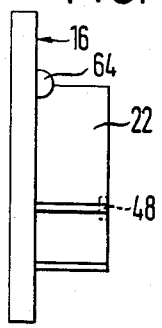
FIG. 5
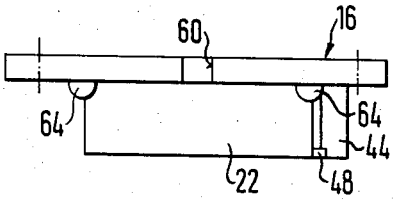
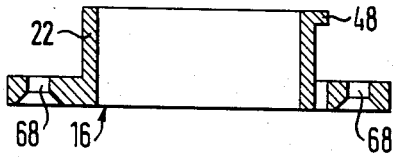
FIG. 6
FIG. 7
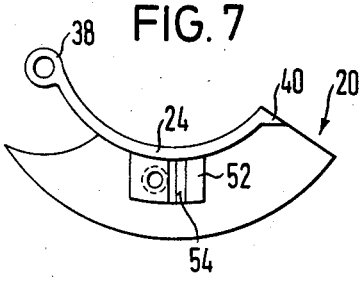
FIG. 8
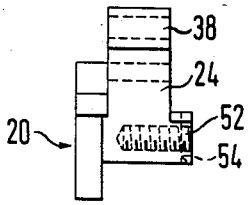
FIG. 9
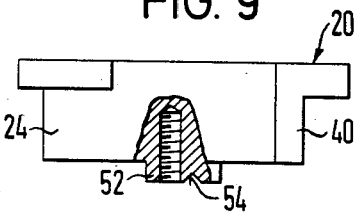

CONSTRUCTION KIT FOR PRODUCING LIGHT-TUBE SYSTEMS FOR THREE-DIMENSIONAL FRAMEWORKS

BACKGROUND OF THE INVENTION

The present invention relates to a construction kit for producing lighting-tube systems or three-dimensional frameworks, comprising tubes connected by connecting pieces, wherein the connecting pieces each have at least one tubular extension, and wherein the tubes are divided along axis-parallel surface lines into two interlockable tube shells. The tubes have, at each of their ends a horseshoe-shaped end flange. The end flange is connected to one of the tube shells, and can be pushed in a radial direction onto the tubular extension of the connecting piece. The end flange is also connected to an arcuate closing flange which can be locked with the end flange to form a closed ring surrounding the tubular extension.

A construction kit of this type is known from European Patent No. 0,018,005 of the applicant. The end flange serves, together with the closing flange, to fasten the tube rotatably to the tubular extension of the adjoining connecting piece. The advantage of the horseshoe-shaped design of the end flange is that, when a tube is exchanged in an already-installed three-dimensional framework, the tube shell of a new tube to be inserted, which is connected to the end flanges, can be introduced into the gap in the three-dimensional framework with a purely radial movement. The tube shell can be connected to the tubular extensions by means of the closing flanges, without having to change the position of the adjacent, already-installed tubes.

In a conventional constructional kit, the closing flange can be released completely from the end flange. By means of leaf springs projecting tangentially from the outer periphery at both ends of the closing flange, the conventional closing flange can be locked on inner projections of the tube shell connected to the end flange.

A disadvantage of this conventional construction kit is that the closing flanges can easily be lost and have to be held in a suitable position by hand before being locked on the tube end. The axial position of the closing flanges often has to be corrected once again after locking.

An object of the present invention is to simplify the locking of the closing flanges in the position provided and to ensure that the closing flanges cannot be lost.

This object is achieved according to the present invention, due to the fact that the closing flange is articulated in the form of a hinge to the end flange by means of one arc end.

The closing flange is therefore always connected with the end flange. When assembling the tube, the fitter has both hands free to bring the tube into a suitable position in relation to the adjoining connecting pieces and to push it radially onto the tubular extensions when the closing flanges have been swung open. When the closing flanges are subsequently swung closed and locked, a correct fit of the closing flange is guaranteed because of the hinge-shaped connection to the end flanges.

Further objects, features and advantages of the present invention will become apparent from the detailed description of preferred emobodiments when considered together with the attached figures of drawing.

BRIEF DESCRIPTION OF THE DRAWINGS

In the drawings:

FIGS. 3 to 5 show the closing flange in a horizontal projection, a side view and a plan view, respectively;

FIG. 6 is a section along the line V—V in FIG. 3;

FIGS. 7 to 9 show a horizontal projection, a side view and a plan view of the closing flange, respectively.

DETAILED DESCRIPTION OF THE PREFERRED EMBODIMENTS

Figure 1:
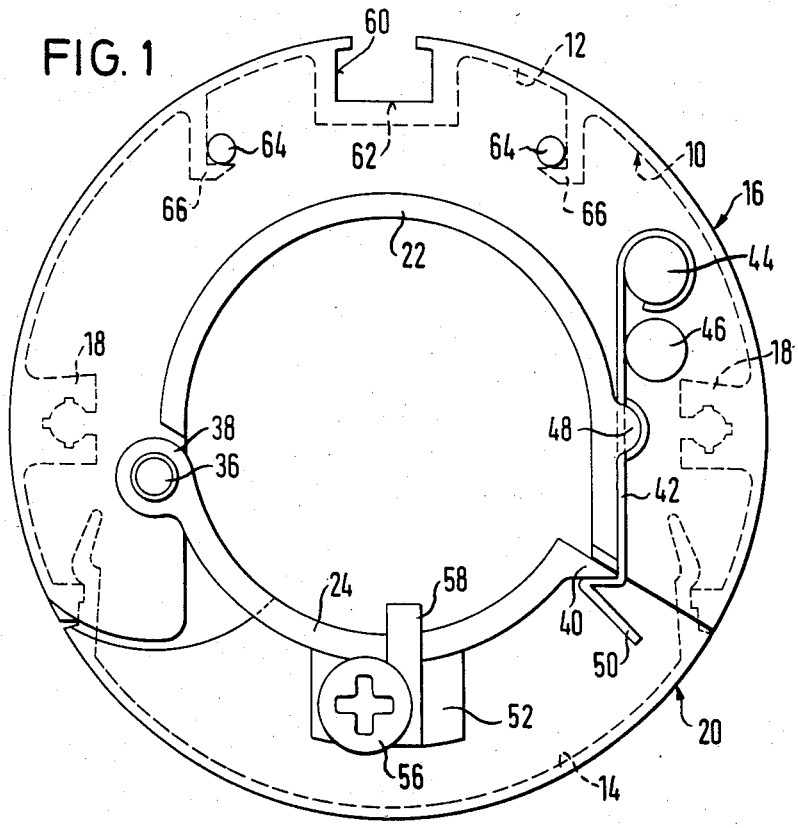
FIG. 1 shows a view of the end faces, on the same side as the tube, of an end flange and of a closing flange.

FIG. 1 indicates, by broken lines, the profile of a tube 10 which comprises an upper tube shell 12 and a lower tube shell 14 locked with the upper shell 12. A horseshoe-shaped end flange 16, illustrated in detail in FIGS. 3 to 6, is fastened to the end of the tube 10. The end flange 16 is screwed to inner extension strips 18 of the upper tube shell 12. The legs of the end flange 16 terminate respectively at the junction between the upper tube shell 12 and the lower tube shell 14.

An arcuate closing flange 20, shown in detail in FIGS. 7 to 8, completes the end flange 16 so as to form a closed ring. The end flange 16 and the closing flange 20 have, on their respective inner peripheral edges, a web 22 or 24, respectively which projects axially into the interior of the tube 10.

Figure 2:
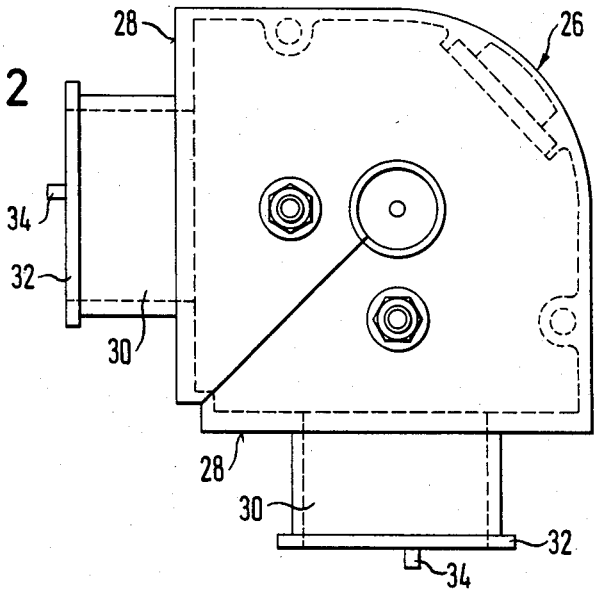
FIG. 2 is a side view of a connecting piece.

FIG. 2 illustrates as an example a connecting piece 26 which serves for connecting two tubes 10 at right angles to one another. The connecting piece 26 shown on a reduced scale has annular bearing surfaces 28 for the end and closing flanges of the adjoining tubes. There projects from each bearing surface 28 a coaxial tubular extension 30 which, in the assembled position, is surrounded in the manner of a sleeve by the webs 22, 24 of the end flange 16 and of the closing flange 20. At the free end, the tubular extension 30 has a collar 32 which projects radially outwards, and, which fixes the webs 22, 24, respectively in an axial direction. Furthermore, there is, in a predetermined position on the periphery of the tubular extension 30, an axially projecting stop 34, the significance of which will be explained later.

The end flange 16 has, on the left in FIGS. 1 and 3, adjacent to its inner edge, a pivot pin 36 which forms a hinge axis for the closing flange 20. A peripherally projecting extension of the web 24 of the closing flange has at the free end a lug 38 mounted on the pivot pin 36. The edges of the end flange 16 and of the closing flange 20 are curved convexly and concavely, respectively, at the end of the flange located on the same side as the hinge and describe circular arcs about the hinge axis. The closing flange 20 can be pivoted outwards about the pivot pin 36 to such an extent that when the tube 10 is assembled the tubular extension 30 can penetrate from below between the legs of the end flange 16.

The free end of the closing flange 20 can be locked with the end flange 16. For this purpose, a nose 40 is provided on the web 24, for engaging a first, hook-shaped end of a leaf spring 42. The leaf spring 42 is fixed by means of its second, upper end to a first peg 44 of the end flange 16 and is supported by a second peg 46 in such a way that it rests against a straight portion of the web 22 of the end flange 16. Preferably, the leaf spring 42 is fixed in an axial direction by the end flange 16, on the one hand, and by a radial projection 48 on the axially inner end of the web 22, on the other hand, but axial fixing is not absolutely necessary.

When the closing flange 20 is to be swung open so that the end flange can be released from the tubular extension 30, the lower tube shell 14 is first removed and the leaf spring 42 is bent outwards by applying pressure on a tongue 50 at the lower end of the leaf spring so that the leaf spring releases the nose 40. The first lower end of the leaf spring can easily be reached by the user, is angled in the form of a hook. The closing flange 20 thereupon swings open because of its own weight. In this way, the connection between the end and closing flanges 16, 20 and the tubular extension 30 can be released very simply by a single manipulation.

When the closing flange 20 is pivoted into the closed position again, the nose 40 describes a circular arc about the pivot pin 36. The tongue 50 of the leaf spring 42 is advantageously adjusted in such a way that it forms an acute angle with the path of movement of the nose 40. In this case, when the nose 40 slides onto the tongue 50, the leaf spring 42 is bent outwards. Thus, to lock the closing flange 20 it is not necessary to actuate the leaf spring 42, but merely to press the free end of the closing flange 20 upwards.

According to FIGS. 8 and 9, the closing flange 20 has a socket 52 projecting inwards in an axial direction beyond the web 24. A limiting peg 58 projecting radially inwards beyond the web 24 is fixed in an essentially radially extending groove 54 in the socket by means of a screw 56 or in another way. The limiting peg 58 interacts with the stop 34 on the tubular extension 30 and limits the angular amount by which the tube 10 can be rotated in relation to the end piece 26. This limitation of the rotary movement guarantees that leads running through the connecting piece 26 and the tube 10 cannot be twisted too much.

According to FIGS. 3 to 5, the end flange 16 has at its upper vertex a recess 60 which is aligned with an undercut groove 62 of the tube 10 which serves for fastening hangers or the like. The end flange 16 is also provided with guide pegs 64 which engage with angular profiles 66 of the upper tube shell 12 and which make it easier to position the end flange before it is screwed to the upper tube shell 12. Screwholes 68 are provided for screwing the end flange 16 to the extension strips 18.

I claim:

1. A construction kit for producing lighting tube systems, comprising:

a plurality of lighting tube assemblies; and at least one connecting piece for connecting together at least two of said lighting tube assemblies to produce a multi-dimensional framework, each connecting piece including at least one extension member, wherein each of said lighting tube assemblies comprises:

a lighting tube having a central longitudinal axis and having a first longitudinal tube shell portion and a second longitudinal tube shell portion for interlocking with the first tube shell portion;

a horseshoe-shaped end flange attached to each end of the first tube shell portion, said horseshoe-shaped end flange being adapted to slide onto an extension member of the connecting piece in a radial direction;

an arcuate closing flange and means for pivotally connecting one of said closing flanges with each horseshoe-shaped end flange; and means for locking each closing flange in a closed position forming a closed ring configuration with its connected horseshoe-shaped end flange, wherein the closed ring configuration surrounds one of said extension members and connects the first tube shell with the connecting piece.

2. An assembled lighting tube system, comprising a plurality of lighting tube assemblies joined together by a plurality of connecting pieces to form a three-dimensional framework, wherein said lighting tube assemblies and said connecting pieces are as defined by claim 1.

3. A construction kit according to claim 1, further comprising a web disposed on a concave, inner edge of said arcuate closing flange, and having an extension on a first end of the closing flange; wherein said means for pivotally connecting comprise a pivot pin disposed on said horseshoe-shaped end flange, and a lug disposed on the extension of the web, said lug pivoting the closing flange around the pivot pin.

4. A construction kit according to claim 3, wherein said first end of the closing flange has a concave shape substantially defined by a circle having the pivot pin as a center; and wherein the horseshoe-shaped end flange has a first end adjacent to the first end of the closing flange, and having a convex shape substantially defined by a circle having the pivot pin as a center.

5. A construction kit according to claim 1, wherein said means for locking the closing flange comprise a leaf spring having a first, free end for locking the closing flange and a second end fastened to the horseshoe-shaped end flange.

6. A construction kit according to claim 5, wherein said means for locking the closing flange comprise a nose disposed on a second end of the closing flange, and wherein said free end of said leaf spring comprises a hook shape for engaging the nose.

7. A construction kit according to claim 6, further comprising a first peg for fastening the leaf spring to the horseshoe-shaped end flange, and a second pin for biasing the leaf spring against the nose for locking the closing flange in the closed position, wherein elastically bending the leaf spring releases the closing flange from the closed position.

8. A construction kit according to claim 7, further comprising a web disposed on the horseshoe-shaped end flange, and a portion of the web for holding the leaf spring against the horseshoe-shaped end flange.

9. A construction kit according to claim 7, wherein said hook shape of said leaf spring points toward the central long axis of said tube and makes an acute angle with a circle having the pivot pin as a center.

10. A construction kit according to claim 1, further comprising means for limiting an angle through which the lighting tubes can be rotated with respect to the extension member comprising a limiting peg disposed on the closing flange and for projecting substantially toward the central long axis of the lighting tube, and at least one stop for engaging the limiting peg, disposed on said extension member and extending substantially parallel to the central axis.

11. A construction kit according to claim 5, further comprising a first peg for fastening the leaf spring to the horseshoe-shaped end flange, and a second pin for biasing the leaf spring against the nose for locking the closing flange in the closed position, wherein elastically bending the leaf spring releases the closing flange from the closed position.

* * * * *